US011817256B2

(12) United States Patent
Kim et al.

(10) Patent No.: US 11,817,256 B2
(45) Date of Patent: Nov. 14, 2023

(54) NOISE REDUCTION DEVICE FOR TRANSFORMER

(71) Applicant: HYOSUNG HEAVY INDUSTRIES CORPORATION, Seoul (KR)

(72) Inventors: Do Jin Kim, Changwon-si (KR); Chul Jun Park, Busan (KR); Kyo Ho Lee, Gimhae-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 667 days.

(21) Appl. No.: 16/967,009

(22) PCT Filed: Dec. 21, 2018

(86) PCT No.: PCT/KR2018/016412
§ 371 (c)(1),
(2) Date: Aug. 3, 2020

(87) PCT Pub. No.: WO2019/151647
PCT Pub. Date: Aug. 8, 2019

(65) Prior Publication Data

US 2021/0027938 A1 Jan. 28, 2021

(30) Foreign Application Priority Data

Feb. 5, 2018 (KR) ..... 10-2018-0013854

(51) Int. Cl.
*H01F 27/33* (2006.01)
*H01F 27/24* (2006.01)
*H01F 27/30* (2006.01)

(52) U.S. Cl.
CPC ..... *H01F 27/33* (2013.01); *H01F 27/24* (2013.01); *H01F 27/30* (2013.01)

(58) Field of Classification Search
CPC ..... H01L 31/035218; H01L 21/02381; H01L 21/02505; H01L 21/02645
See application file for complete search history.

(56) References Cited

U.S. PATENT DOCUMENTS 1,603,058 A * 10/1926 Biermanns ..... H01F 27/324 336/208
2,937,349 A * 5/1960 Guglielmo ..... H01F 27/36 336/84 R (Continued)

FOREIGN PATENT DOCUMENTS

CN 206116168 U 4/2017
JP 2000-252138 A 9/2000

(Continued)

*Primary Examiner* — Mang Tin Bik Lian
(74) *Attorney, Agent, or Firm* — NKL LAW; Jae Youn Kim

(57) ABSTRACT

A noise reduction device for a transformer is proposed. In this device, a blocking means or a connection support means is installed in a winding installed in an inner space of an enclosure in order to remove vibration and noise generated in the enclosure of the transformer. In a low voltage winding and a high voltage winding constituting the winding, when a current is applied, a magnetic flux flow is generated, thereby generating electromagnetic force. The electromagnetic force is transmitted to surfaces of the enclosure through insulating oil or the like inside the enclosure, causing vibration and noise. In order to cancel and eliminate the electromagnetic force, the blocking means or the connection support means is used. According to the disclosure, the electromagnetic force is canceled, thereby reducing the noise and vibration.

11 Claims, 11 Drawing Sheets

(56) References Cited

U.S. PATENT DOCUMENTS

| | | | | |
|---|---|---|---|---|
| 3,353,129 | A * | 11/1967 | Leibinger | H01F 27/363 336/84 R |
| 6,326,877 | B1 * | 12/2001 | Hay | H01F 27/306 336/12 |
| 7,830,233 | B2 * | 11/2010 | Hrkac | H01F 41/063 336/170 |
| 9,837,202 | B2 * | 12/2017 | Kainaga | H01F 27/28 |
| 2010/0007452 | A1 * | 1/2010 | Forsberg | H01F 27/36 29/606 |
| 2011/0316662 | A1 * | 12/2011 | Pregartner | H01F 27/36 336/221 |
| 2013/0093559 | A1 * | 4/2013 | Xu | H01F 27/33 336/210 |
| 2017/0169938 | A1 * | 6/2017 | Kainaga | H01F 27/28 |
| 2018/0166209 | A1 * | 6/2018 | Ishikura | H01F 27/323 |
| 2018/0204670 | A1 * | 7/2018 | Miyamoto | H01F 27/324 |

FOREIGN PATENT DOCUMENTS

| | | | |
|---|---|---|---|
| KR | 10-1339153 | B1 | 12/2013 |
| KR | 10-1596399 | B1 | 2/2016 |

* cited by examiner

NOISE REDUCTION DEVICE FOR TRANSFORMER

TECHNICAL FIELD

The present disclosure relates to a noise reduction device for a transformer and, more particularly, to a noise reduction device for a transformer that reduces noise generated in a low voltage winding and a high voltage winding that are wound around a core.

BACKGROUND ART

FIG. 1 is a view schematically showing a main part of a transformer configuration. A core 3 is installed inside an enclosure 1 constituting the external appearance of a transformer, and windings 5 and 7 are installed on the core 3. The windings 5 and 7 are respectively composed of a low voltage winding 5 wound around the core 3 and a high voltage winding 7 wound around the low voltage winding 5. The low voltage winding 5 and the high voltage winding 7 are wound in a substantially cylindrical shape. An assembly composed of the core 3 and the windings 5 and 7 is installed inside the enclosure 1, and insulating oil is filled inside the enclosure 1.

When current is applied to the low voltage winding 5 and the high voltage winding 7, a magnetic flux flow is generated, and electromagnetic force is generated in the low voltage winding 5 and the high voltage winding 7. As shown in FIG. 1, the electromagnetic force is generated in the direction toward the core 3 in the low voltage winding 5, and the electromagnetic force is generated in the opposite direction to the core 3 in the high voltage winding 7. Due to such electromagnetic force, movement occurs in the low voltage winding 5 and the high voltage winding 7, and vibration is generated in the insulating oil by the movement, whereby there is a problem in that the vibration is generated in the enclosure 1 as well.

In order to solve this problem, conventionally, a method of reducing leakage magnetic flux density has been used by increasing the heights of the low voltage winding 5 and the high voltage winding 7. However, in this case, as the sizes of the low voltage winding 5 and the high voltage winding 7 increase, the size of the enclosure 1 accommodating the windings also increases, thereby causing a problem in that the size of the transformer increases as a whole.

DISCLOSURE

Technical Problem

An objective of the present disclosure is to solve the conventional problem as described above, and the objective is to minimize vibration generated in a high voltage winding and a low voltage winding when a transformer is operated by applying current to the high voltage winding and the low voltage winding.

Technical Solution

According to the characteristics of the present invention in order to achieve the objectives as described above, the present invention includes: a winding including a low voltage winding installed around a leg of a core and a high voltage winding installed around the low voltage winding; and a blocking means installed at each of upper and lower ends of the low voltage winding and at each of upper and lower ends of the high voltage winding, and generating repulsive force corresponding to electromagnetic force generated when a magnetic flux flow is generated by applying current to the low voltage winding and the high voltage winding.

The blocking means may include a close contact piece in close contact with an end surface of the low voltage winding or the high voltage winding, and a support piece configured to be orthogonal with respect to the close contact piece and inserted into the low voltage winding or the high voltage winding.

The close contact piece or the support piece may be configured as a ring shape.

In the low voltage winding, the support piece of the blocking means may be installed at a position adjacent to an outer diameter surface of the low voltage winding, and in the high voltage winding, the support piece of the blocking means may be installed at a position adjacent to an inner diameter surface of the high voltage winding.

In the low voltage winding, the support piece of the blocking means may be inserted into the low voltage winding at a point distanced from the outer diameter surface by a length based on one third of a thickness of the low voltage winding, and in the high voltage winding, the support piece of the blocking means may be inserted into the high voltage winding at a point distanced from the inner diameter surface by a length based on one third of a thickness of the high voltage winding.

According to another characteristic of the present invention, the present invention includes: a winding including a low voltage winding installed around a leg of a core and a high voltage winding installed around the low voltage winding; and a connection support means wherein a low voltage side connection part passing through the low voltage winding such that opposite ends thereof protrude from upper and lower ends of the low voltage winding, a high voltage side connection part passing through the high voltage winding such that opposite ends thereof protrude from upper and lower ends of the high voltage winding, and the high voltage side connection part and the low voltage side connection part are combined with each other, so as to cancel out electromagnetic force generated from the low voltage winding and the high voltage winding.

The low voltage side connection part of the upper end of the low voltage winding and the high voltage side connection part of the upper end of the high voltage winding may overlap each other, and may be combined with each other by heat-sealing, and the low voltage side connection part of the lower end of the low voltage winding and the high voltage side connection part of the lower end of the high voltage winding may overlap each other, and may be combined with each other by heat-sealing.

The low voltage side connection part of the upper end of the low voltage winding and the high voltage side connection part of the upper end of the high voltage winding may overlap each other multiple times, and may be combined with each other, and the low voltage side connection part of the lower end of the low voltage winding and the high voltage side connection part of the lower end of the high voltage winding may overlap each other multiple times, and may be combined with each other.

The low voltage side connection part and the high voltage side connection part may be combined with each other by forming a first adhesive part in a state of overlapping in close contact with end surfaces of the low voltage winding and the high voltage winding, and the low voltage side connection part and the high voltage side connection part combined with each other by forming of the first adhesive part may be in close contact with the low voltage side connection part or the high voltage side connection part again, thereby being combined with each other by forming a second adhesive part.

In the low voltage winding, the connection support means may be installed at a position adjacent to an outer diameter surface of the low voltage winding, and in the high voltage winding, the connection support means may be installed at a position adjacent to an inner diameter surface of the high voltage winding.

In the low voltage winding, the connection support means may pass through a point distanced from the outer diameter surface by a length based on one third of a thickness of the low voltage winding, and in the high voltage winding, the connection support means may pass through a point distanced from the inner diameter surface by a length based on one third of a thickness of the high voltage winding.

Advantageous Effects

In the noise reduction device for a transformer according to the present disclosure, the following effects may be obtained.

In an exemplary embodiment of the present disclosure, a blocking means that blocks vibration from occurring in the low voltage winding and the high voltage winding is installed at each of opposite ends of each of the low voltage winding and the high voltage winding, wherein the blocking means is composed of a close contact piece in close contact with the low voltage winding or the high voltage winding and a support piece formed integrally with the close contact piece to reinforce the end of the low voltage winding or the high voltage winding. Such a blocking means reinforces the opposite ends of each of the low voltage winding and the high voltage winding, whereby repulsive force against the generated electromagnetic force is generated, and thus the vibration is prevented from occurring.

In another exemplary embodiment of the present disclosure, a low voltage side connection support means positioned through the upper and lower parts of the low voltage winding and a high voltage side connection support means positioned through the upper and lower parts of the high voltage winding are connected to each other so that the low voltage winding and the high voltage winding are connected to each other, whereby the electromagnetic force generated on the low voltage winding side and the electromagnetic force generated on the high voltage winding side cancel each other out, and thus an effect of suppressing vibration generation may be obtained.

Meanwhile, in another exemplary embodiment of the present disclosure, the low voltage side connection support means and the high voltage side connection support means are bonded and connected to each other, wherein this bonding is repeated a number of times to bond in a manner that forms an adhesive part, so that the low voltage side connection support means and the high voltage side connection support means are more firmly connected to each other, thereby increasing the vibration prevention effect.

MODE OF INVENTION

Figure 1:
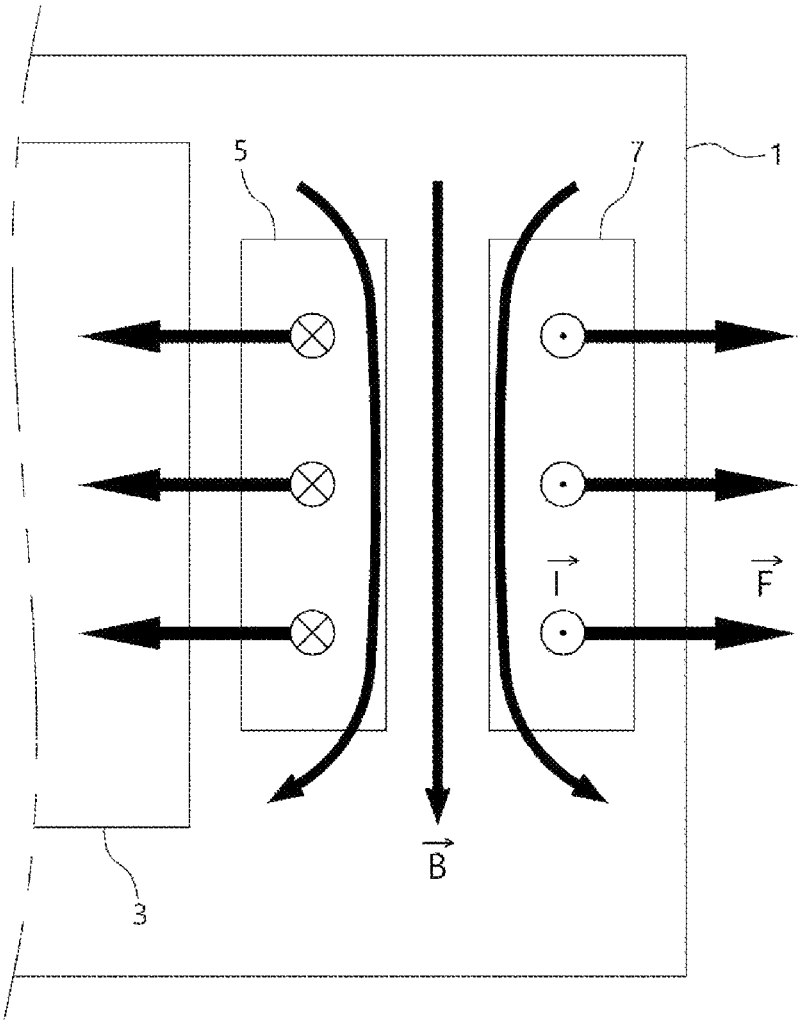
FIG. 1 PRIOR ART
FIG. 1 is a schematic view showing that electromagnetic force is generated in a main part configuration of a typical transformer.
Figure 2:
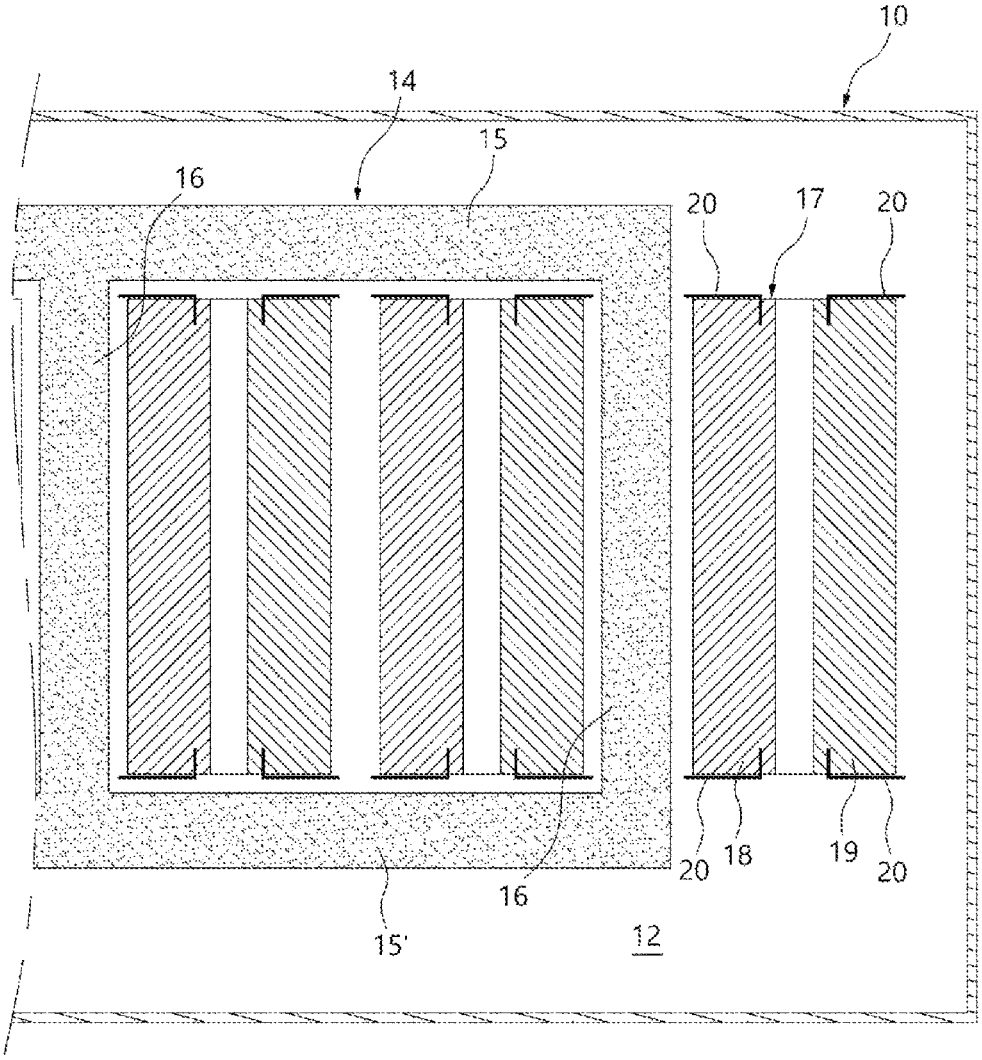
FIG. 2 is a schematic view showing a configuration of a transformer in which a preferred exemplary embodiment of a noise reduction device for a transformer according to the present disclosure is applied.

Hereinafter, some exemplary embodiments of the present disclosure will be described in detail through exemplary drawings. In adding reference numerals to the components of each drawing, it should be noted that the same reference numerals are used to refer to the same components as much as possible even if displayed on different drawings. Further, in the following description, if it is decided that the detailed description of a known function or configuration related to the disclosure makes the subject matter of the disclosure unclear, the detailed description is omitted.

In addition, in describing the components of the exemplary embodiments of the present disclosure, terms such as first, second, A, B, (a), (b), and the like can be used. Since these terms are provided merely for the purpose of distinguishing the components from each other, they do not limit the nature, sequence, or order of the components. If a component is described as being "connected", "coupled", or "linked" to another component, that component may be directly connected or connected to that other component, however it should be understood that yet another component between each of the components may be "connected", "coupled", or "linked" to each other.

According to the drawings, the external appearance of a transformer is constituted by an enclosure 10. An inner space 12 is formed inside the enclosure 10, and components to be described below are positioned. The inner space 12 is also filled with an insulating oil.

A core 14 is installed in the inner space 12 of the enclosure 10. The core 14 is provided with a plurality of legs 16 connecting between an upper yoke 15 and a lower yoke 15', wherein the legs 16 have a predetermined interval. The winding 17 is installed on the leg 16 of the core 14.

The winding 17 is wound around the leg 16 of the core 14 in a cylindrical shape as a whole, and is divided into a low voltage winding 18 and a high voltage winding 19. The low voltage winding 18 is installed to surround the leg 16, and the high voltage winding 19 is installed to surround the low voltage winding 18.

Figure 4:
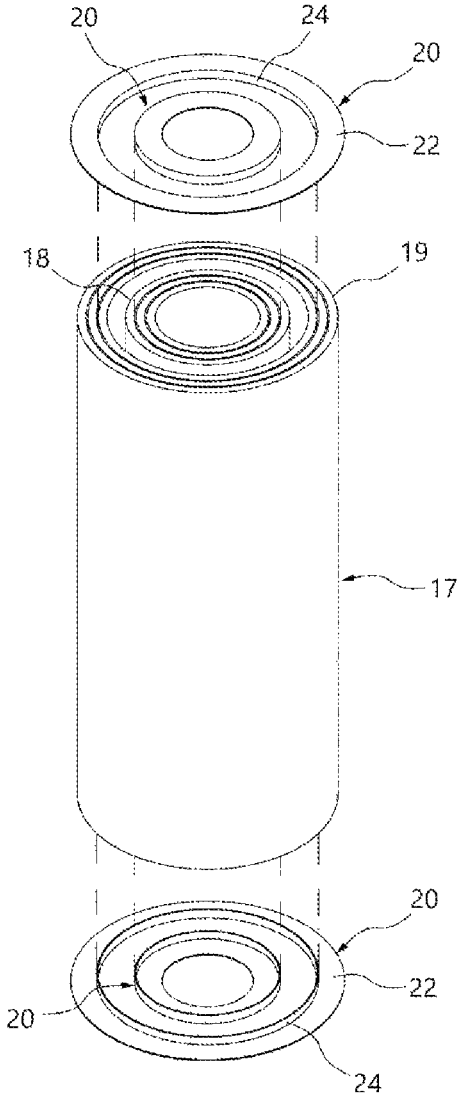
FIG. 4 is an exploded perspective view showing the configuration of the exemplary embodiment shown in FIG. 2.
Figure 5:
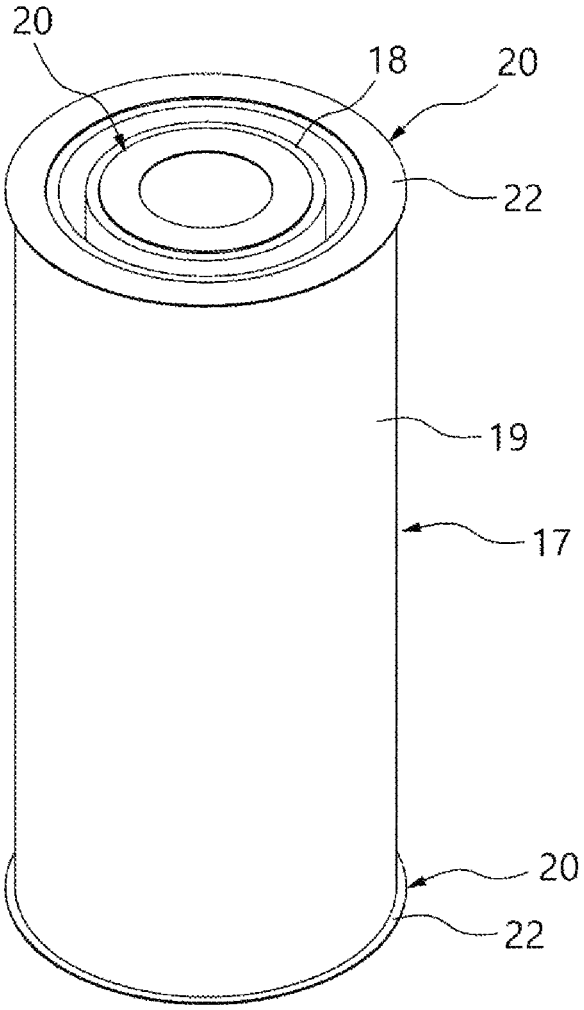
FIG. 5 is a perspective view showing the configuration of the exemplary embodiment shown in FIG. 2.

The upper and lower ends of the low voltage winding 18 and the upper and lower ends of high voltage winding 19 are respectively provided with blocking means 20 installed thereon. The blocking means 20 is composed of a close contact piece 22 and a support piece 24, as can be seen in FIG. 4, etc. The close contact pieces 22 are installed in close contact with the upper part surface and lower part surface of the low voltage winding 18 and the upper part surface and lower part surface of the high voltage winding 19. The support piece 24 is positioned by being inserted into the low voltage winding 18 and the high voltage winding 19. For reference, the blocking means 20 does not constitute one body as a whole, but may be divided into two parts having intervals at an angle of 180 degree or divided into three parts having intervals at an angle of 120 degree. When viewed as a whole, the close contact piece 22 and the support piece 24 are respectively configured as a ring shape.

In the blocking means 20, the close contact piece 22 and the support piece 24 are orthogonal to each other. This configuration aims to maximally generate repulsive force against the electromagnetic force acting on the support piece 24. The close contact piece 22 and the support piece 24 are configured to be orthogonal to each other, whereby the force applied to the support piece 24 may be withstood by the close contact piece 22 together with the support piece 24.

Figure 3:
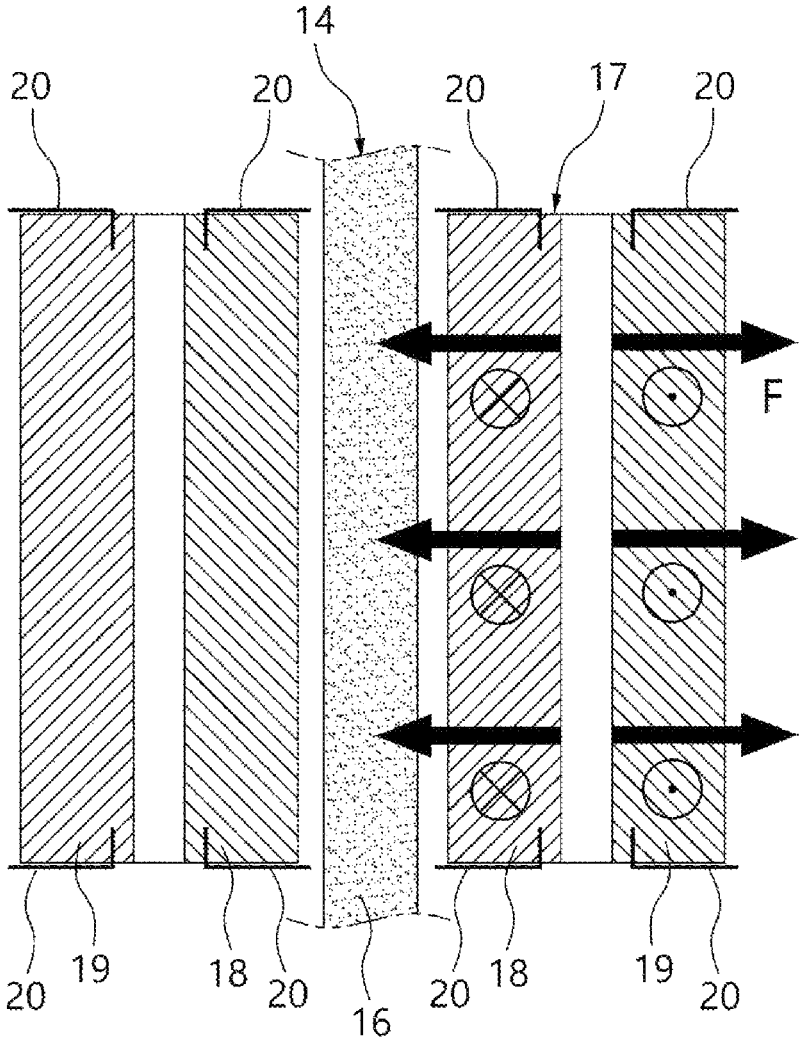
FIG. 3 is a cross-sectional view showing a part of the configuration in the exemplary embodiment shown in FIG. 2 and the generated electromagnetic force.

Hereinafter, a position will be described where the support piece 24 is inserted and installed in the low voltage winding 18 or high voltage winding 19, in the blocking means 20. In the low voltage winding 18, the position is a position of the far side relative to the leg 16 of the core 14, that is, a position adjacent to the outer diameter surface of the low voltage winding 18. The support piece 24 is inserted at a position closer to the outer diameter surface than the inner diameter surface of the low voltage winding 18. The reason for this arrangement is that, as shown in FIG. 3, in the low voltage winding 18, the electromagnetic force is generated most adjacent to the outer diameter surface of the low voltage winding 18.

Whereas, in the high voltage winding 19, the electromagnetic force is generated most at a position adjacent to the inner diameter surface of the high voltage winding 19. Therefore, the support piece 24 is inserted at the position adjacent to the inner diameter surface than the outer diameter surface of the high voltage winding 19. This arrangement is for the purpose of generating maximum repulsive force against electromagnetic force because the electromagnetic force generated in the high voltage winding 19 is generated most at the position adjacent to the inner diameter surface.

In the drawings of the illustrated exemplary embodiment, the support piece 24 is inserted into at a point distanced from the outer diameter surface by a length based on one third of a thickness of the low voltage winding 18. In the case of the high voltage winding 19, the support piece 24 is inserted into at a point distanced from the inner diameter surface by a length based on one third of a thickness of the high voltage winding 19. This arrangement is due to the installation rigidity of the support piece 24 and the generation position of the electromagnetic force.

Meanwhile, another exemplary embodiment of the present disclosure is shown in FIGS. 7 to 10. Here, the low voltage winding 18 and the high voltage winding 19 are connected to each other by using a connection support means 30, whereby the electromagnetic force generated in the low voltage winding 18 and the electromagnetic force generated in the high voltage winding 19 are cancelled each other out to remove the electromagnetic force.

In the present exemplary embodiment, the connection support means 30 is made of a synthetic resin having a band shape, wherein a low voltage side connection part 30' installed on the low voltage winding 18 and a high voltage side connection part 30" installed on the high voltage winding 19 are connected to each other to be configured as a square frame as a whole. In the connection support means 30, the low voltage side connection parts 30' and the high voltage side connection parts 30" are respectively connected to each other at the upper and lower parts of the low voltage winding 18 and the high voltage winding 19, thereby having the square frame shape. In the illustrated exemplary embodiment, there are four connection support means 30, but this configuration is not mandatory, and the number of the connection support means used herein varies depending on design conditions.

It will be described with reference to FIGS. 10(*a*)-10(*d*) that the low voltage side connection part 30' and the high voltage side connection part 30" are connected and combined with each other.

Figure 8:
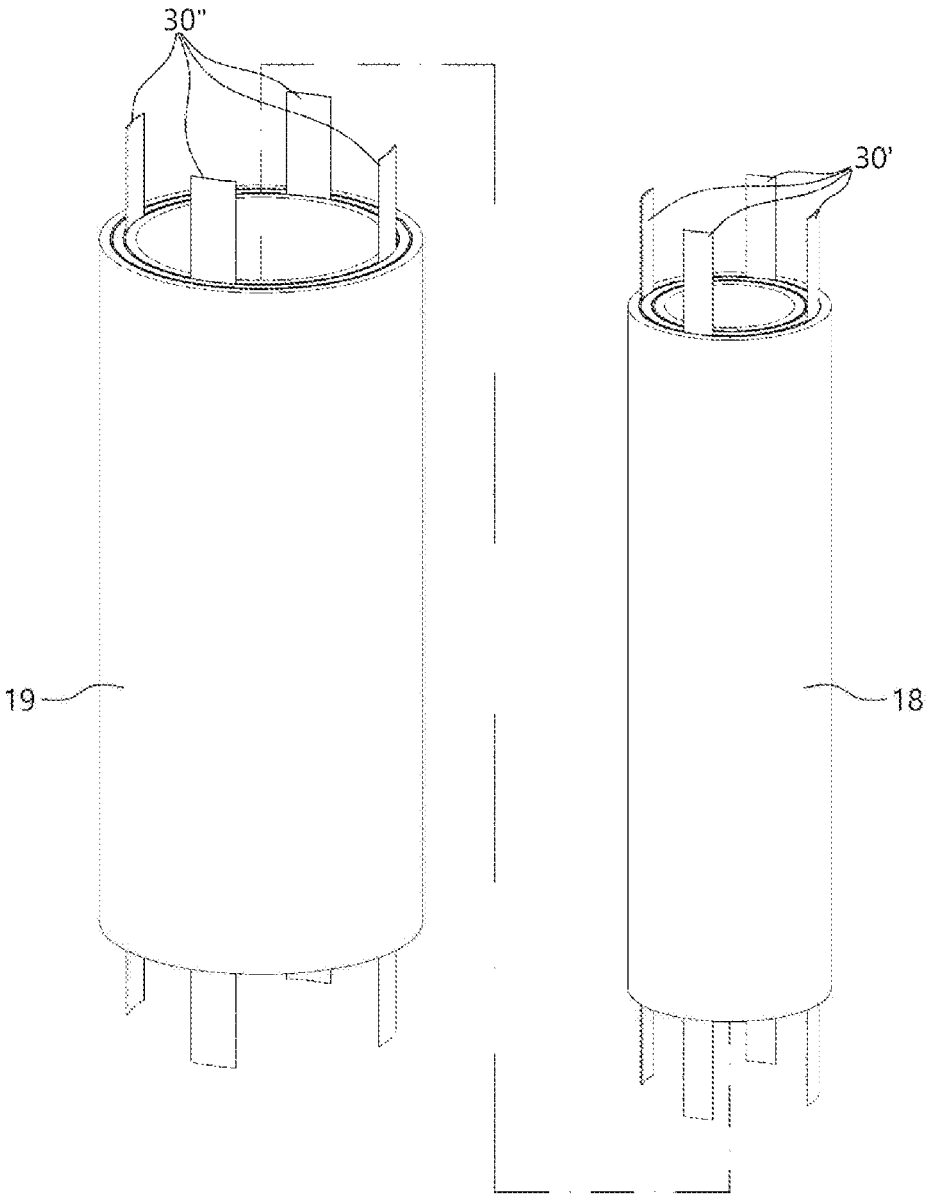
FIG. 8 is an exploded view showing a configuration for constituting the exemplary embodiment shown in FIG. 7.

Before installing to the core 14, each of the low voltage winding 18 and high voltage winding 19 is formed in a cylindrical shape as shown in FIG. 8. At this time, the low voltage side connection parts 30' of the connection support means 30 protrudes by a predetermined length toward the upper and lower parts of the low voltage winding 18. The high voltage side connection parts 30" of the connection support means 30 also protrudes separately by a predetermined length toward the upper and lower parts of the high voltage winding 19.

Figure 9:
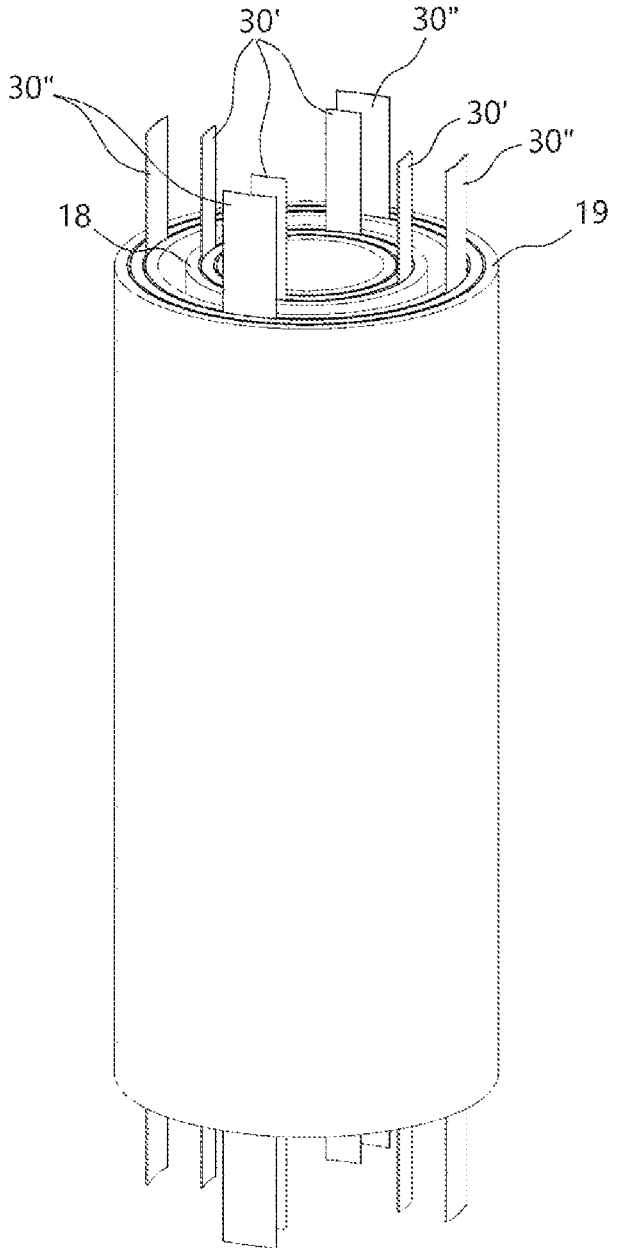
FIG. 9 is a perspective view showing a process of constituting the exemplary embodiment shown in FIG. 7.
Figure 10A:
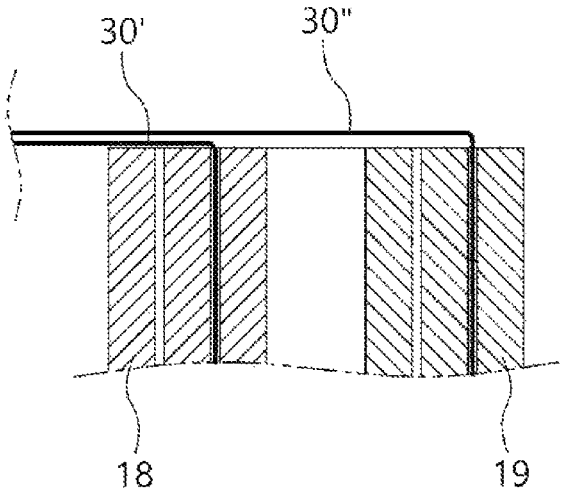
FIGS. 10(*a*)-10(*d*) are working state views sequentially showing the process of constituting a connection support means in the exemplary embodiment shown in FIG. 7.
Figure 10B:
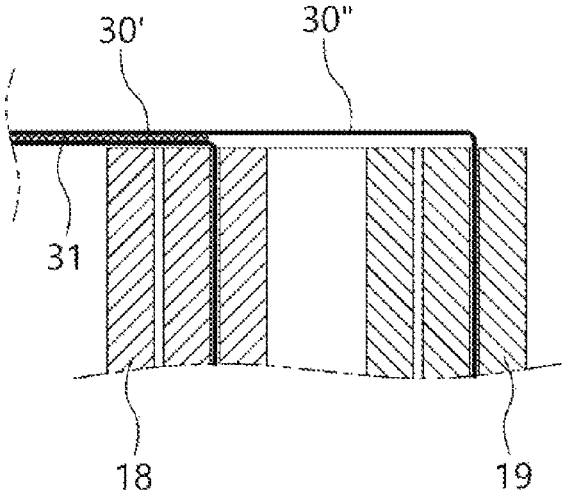
Figure 10C:
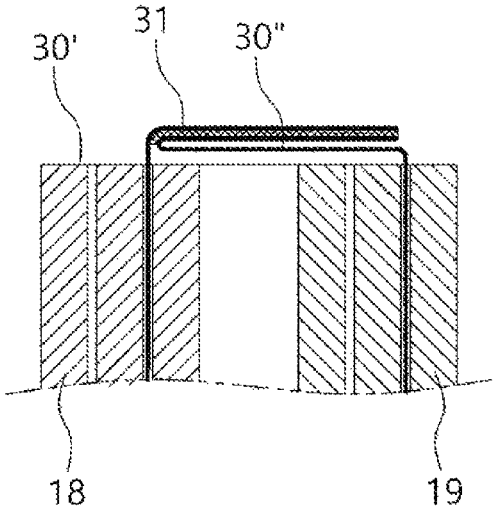
Figure 10D:
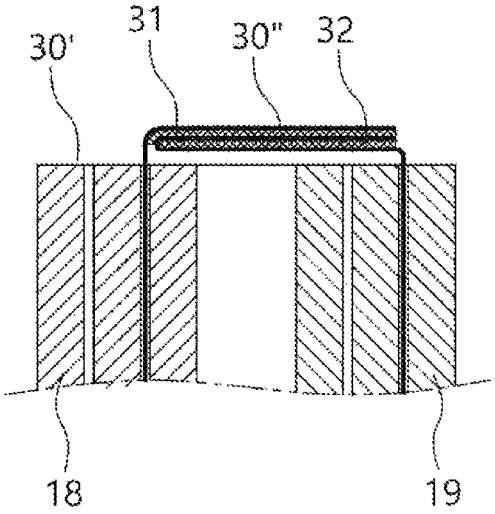

The low voltage winding 18 in such a state is positioned inside the high voltage winding 19, so as to make the state shown in FIG. 9. Next, in a state of having no yokes 15 and 15' on one side of the core 14, the low voltage winding 18 and the high voltage winding 19 are simultaneously inserted into the leg 16.

Meanwhile, it is shown in FIGS. 10(*a*)-10(*d*) that the low voltage side connection part 30' of the low voltage winding 18 and the high voltage side connection part 30" of the high voltage winding 19 are connected to each other.

The state shown in FIG. 10(*a*) is a state in which the low voltage side connection part 30' and the high voltage side connection part 30" protrude and overlap each other. That is, in a state in which the low voltage side connection part 30' is seated on the upper part surface or lower part surface of the low voltage winding 18, the high voltage side connection part 30" is overlapped the low voltage side connection part 30'.

Next, an adhesive is applied between the overlapped low voltage side connection part 30' and the high voltage side connection part 30", so that the low voltage side connection part 30' and the high voltage side connection part 30" are bonded to each other by a predetermined length. At this time, a length in which the low voltage side connection part 30' and the high voltage side connection part 30" are bonded to each other is as long as a distance between the low voltage side connection part 30' protruding from the low voltage winding 18 and the high voltage side connection part 30" protruding from the high voltage winding 19. The adhesive is applied between the low voltage side connection part 30' and the high voltage side connection part 30" to form a first adhesive part 31. Such a state is shown in FIG. 10(*b*).

Next, the low voltage side connection part 30' and the high voltage side connection part 30", which are bonded to each other by the formed first adhesive part 31, are folded in an opposite direction to be seated on the high voltage side connection part 30". Such a state is shown in FIG. 10(*c*).

After the state of FIG. 10(*c*) is made, the adhesive is applied between a portion of the high voltage side connection part 30" forming the first adhesive part 31 and a high voltage side connection part 30" protruding from the high voltage winding 19, so as to form a second adhesive part 32. Such a state is shown in FIG. 10(*d*).

For reference, the length of the low voltage side connection part 30' and the high voltage side connection part 30" that are bonded by the first adhesive part 31 is doubled or tripled, so that a third adhesive part and a fourth adhesive part are made, whereby a thickness of the portion in which the low voltage side connection part 30' and the high voltage side connection part 30" are bonded to each other may be made thicker. This depends on the design conditions.

Meanwhile, the low voltage side connection part 30' is seated on the end surfaces of the low voltage winding 18 and the high voltage winding 19 so as to extend toward the high voltage side connection part 30", the high voltage side connection part 30" is also placed to be superimposed on the low voltage side connection part 30', and heat and pressure are applied thereto, whereby the low voltage side connection part 30' and the high voltage side connection part 30" may be combined by heat-sealing.

In addition, as described above, the low voltage side connection part 30' and the high voltage side connection part 30" are combined by way of forming the first adhesive part 31 and the second adhesive part 32, but the portion overlapped multiple times may also be combined at a time by the heat-sealing.

In addition, in FIG. 10(*a*), a method is described in such a way that the low voltage side connection part 30' is in close contact with the end surface of the low voltage winding 18 and then the high voltage side connection part 30" is in close contact thereon, but the method may be made in a reverse way. That is, the reverse way refers to a method, wherein the high voltage side connection part 30" is in close contact with the end surface of the high voltage winding 19, and then the low voltage side connection part 30' is in close contact thereon, so as to form the first adhesive part 31.

Hereinafter, it will be described in detail that the noise is blocked by the noise reduction device for the transformer according to the present disclosure, the noise reduction device having the configuration as described above.

When a current is applied to the low voltage winding 18 and the high voltage winding 19 installed inside the enclosure 10 of the transformer, magnetic flux flow is generated, and also electromagnetic force is generated. As can be seen in FIG. 3 by the application of current along the winding direction of the coil as shown in FIG. 3, when the low voltage winding 18 itself is taken into consideration, the greatest electromagnetic force is applied in the direction toward the leg 16 of the core 14 at a position adjacent to the outer diameter surface of the low voltage winding 18.

In addition, when the high voltage winding 19 itself is taken into consideration, the greatest electromagnetic force is applied in the opposite direction to the leg 16 of the core 14 at a position adjacent to the inner diameter surface of the high voltage winding 19. Such electromagnetic force acts in a direction toward the outer diameter surface from the inner diameter surface side of the high voltage winding 19, so as to be transmitted to the enclosure 10 through the insulating oil filled in the inner space 12, thereby generating vibration and noise.

Figure 6:
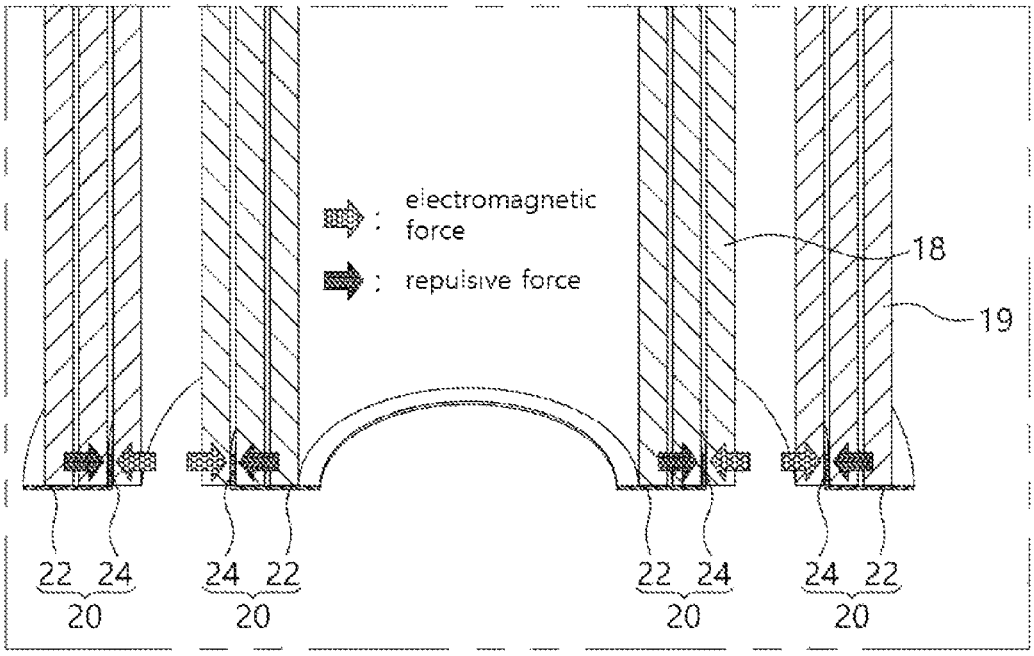
FIG. 6 is a cross-sectional view showing interaction between the electromagnetic force and repulsive force in the exemplary embodiment shown in FIG. 2.
Figure 7:
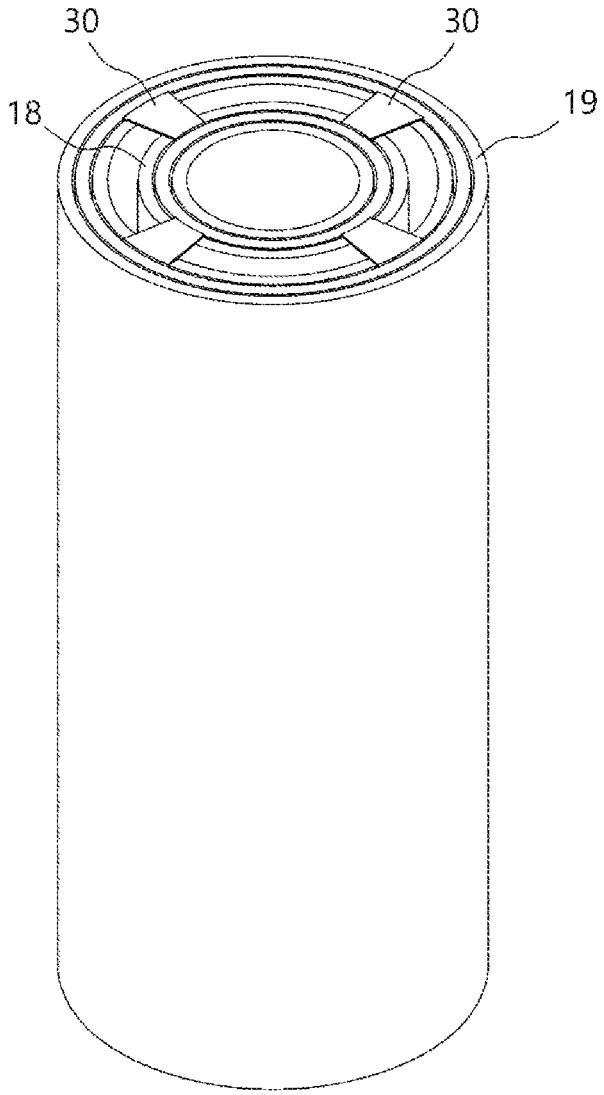
FIG. 7 is a perspective view showing another exemplary embodiment of the present disclosure.

However, in the present disclosure, each of the blocking means 20 is installed on the upper and lower ends of the low voltage winding 18 and the high voltage winding 19 to generate the repulsive force against the electromagnetic force, thereby cancelling the electromagnetic force out. Such an operation is well illustrated in FIG. 6. Here, in the upper and lower ends of the low voltage winding 18, the greatest electromagnetic force is generated at the position adjacent to the outer diameter surface of the low voltage winding 18, and in order to cancel the electromagnetic force out, the support piece 24 of the blocking means 20 is positioned at the position adjacent to the outer diameter surface of the low voltage winding 18.

In addition, in the upper end and the lower end of the high voltage winding 19, since the greatest electromagnetic force is generated at a position adjacent to the inner diameter surface of the high voltage winding 19, the support piece 24 of the blocking means 20 is positioned at the position adjacent to the inner diameter surface of the high voltage winding 19 in order to cancel the electromagnetic force out.

As such, each of the support piece 24 of the blocking means 20 serves to reinforce the upper and lower ends of the low voltage winding 18 and the upper and lower ends of the high voltage winding 19, so as to generate the repulsive force against the electromagnetic force, thereby preventing the occurrence of vibration or noise.

Meanwhile, in FIGS. 10(*a*)-10(*d*), it can be seen that the generated electromagnetic force is canceled out by way of fixing the low voltage winding 18 and the high voltage winding 19 using the connection support means 30. The low voltage winding 18 and the high voltage winding 19 are connected to each other through the connection support means 30, whereby the electromagnetic force acting toward the leg 16 of the core 14 from the low voltage winding 18 and the electromagnetic forces acting in the opposite direction from the legs 16 of the core 14 cancel each other out. Consequently, when taking into consideration of the entire winding 17, the electromagnetic force is canceled out, thereby blocking the vibration and noise transmitted to the enclosure 10 through the insulating oil of the inner space 12.

In the description above, although the components of the embodiments of the present disclosure may have been explained as assembled or operatively connected as a unit, the present disclosure is not intended to limit itself to such embodiments. That is, within the scope of the present disclosure, all of the components may be selectively combined and operated in any numbers. In addition, the terms "comprise", "include", or "have" described above mean that the corresponding component may be inherent unless otherwise stated, and thus it should be construed that it may further include other components, not to exclude other components. That is, terms like "include", "comprise", and "have" should be interpreted in default as inclusive or open rather than exclusive or closed unless expressly defined to the contrary. In the following description, unless otherwise defined, all terms including technical and scientific terms used herein have the same meaning as commonly understood by one of those skilled in the art to which this disclosure belongs. Commonly used terms, such as predefined terms, should be interpreted as being consistent with the contextual meaning of the related art, and are not to be interpreted as ideal or excessively formal meanings unless explicitly defined in the present disclosure.

Although exemplary aspects of the present disclosure have been described for illustrative purposes, those skilled in the art will appreciate that various modifications, additions, and substitutions are possible, without departing from essential characteristics of the disclosure. Therefore, the embodiments disclosed in the present disclosure are not intended to limit the technical idea of the present disclosure but to describe the present disclosure, and the scope of the technical idea of the present disclosure is not limited by these embodiments. The scope of protection of the present disclosure should be interpreted by the following claims, and all technical ideas within the scope equivalent thereto should be construed as being included in the scope of the present disclosure.

The invention claimed is:

1. A noise reduction device for a transformer, the noise reduction device comprising:

a winding including a low voltage winding installed around a leg of a core and a high voltage winding installed around the low voltage winding; and a blocking means installed at each of upper and lower ends of the low voltage winding and at each of upper and lower ends of the high voltage winding, and generating repulsive force corresponding to electromagnetic force generated when a magnetic flux flow is generated by applying current to the low voltage winding and the high voltage winding, wherein the blocking means comprises a close contact piece in close contact with an end surface of the low voltage winding or the high voltage winding, and a support piece configured to be orthogonal with respect to the close contact piece and inserted into the low voltage winding or the high voltage winding, wherein in the low voltage winding, the support piece of the blocking means is installed at a position adjacent to an outer diameter surface of the low voltage winding, and wherein in the high voltage winding, the support piece of the blocking means is installed at a position adjacent to an inner diameter surface of the high voltage winding.

2. The noise reduction device of claim 1, wherein the close contact piece or the support piece is configured as a ring shape.

3. The noise reduction device of claim 1, wherein, in the low voltage winding, the support piece of the blocking means is inserted into the low voltage winding at a point distanced from the outer diameter surface by a length based on one third of a thickness of the low voltage winding, and in the high voltage winding, the support piece of the blocking means is inserted into the high voltage winding at a point distanced from the inner diameter surface by a length based on one third of a thickness of the high voltage winding.

4. A noise reduction device for a transformer, the noise reduction device comprising:

a winding including a low voltage winding installed around a leg of a core and a high voltage winding installed around the low voltage winding; and a connection support means wherein a low voltage side connection part passing through the low voltage winding such that opposite ends thereof protrude from upper and lower ends of the low voltage winding, a high voltage side connection part passing through the high voltage winding such that opposite ends thereof protrude from upper and lower ends of the high voltage winding, and the high voltage side connection part and the low voltage side connection part are combined with each other, so as to cancel out electromagnetic force generated from the low voltage winding and the high voltage winding, wherein in the low voltage winding, the connection support means is installed at a position adjacent to an outer diameter surface of the low voltage winding, and wherein in the high voltage winding, the connection support means is installed at a position adjacent to an inner diameter surface of the high voltage winding.

5. The noise reduction device of claim 4, wherein the low voltage side connection part of the upper end of the low voltage winding and the high voltage side connection part of the upper end of the high voltage winding overlap each other, and are combined with each other by heat-sealing, and the low voltage side connection part of the lower end of the low voltage winding and the high voltage side connection part of the lower end of the high voltage winding overlap each other, and are combined with each other by heat-sealing.

6. The noise reduction device of claim 4, wherein the low voltage side connection part of the upper end of the low voltage winding and the high voltage side connection part of the upper end of the high voltage winding overlap each other multiple times, and are combined with each other, and the low voltage side connection part of the lower end of the low voltage winding and the high voltage side connection part of the lower end of the high voltage winding overlap each other multiple times, and are combined with each other.

7. The noise reduction device of claim 6, wherein the low voltage side connection part and the high voltage side connection part are combined with each other by forming a first adhesive part in a state of overlapping in close contact with end surfaces of the low voltage winding and the high voltage winding, and the low voltage side connection part and the high voltage side connection part combined with each other by forming of the first adhesive part are in close contact with the low voltage side connection part or the high voltage side connection part again, thereby being combined with each other by forming a second adhesive part.

8. The noise reduction device of claim 4, wherein:

in the low voltage winding, the connection support means passes through a point distanced from the outer diameter surface by a length based on one third of a thickness of the low voltage winding, and in the high voltage winding, the connection support means passes through a point distanced from the inner diameter surface by a length based on one third of a thickness of the high voltage winding.

9. The noise reduction device of claim 5, wherein:

in the low voltage winding, the connection support means passes through a point distanced from the outer diameter surface by a length based on one third of a thickness of the low voltage winding, and in the high voltage winding, the connection support means passes through a point distanced from the inner diameter surface by a length based on one third of a thickness of the high voltage winding.

10. The noise reduction device of claim 6, wherein:

in the low voltage winding, the connection support means passes through a point distanced from the outer diameter surface by a length based on one third of a thickness of the low voltage winding, and in the high voltage winding, the connection support means passes through a point distanced from the inner diameter surface by a length based on one third of a thickness of the high voltage winding.

11. The noise reduction device of claim 7, wherein:

in the low voltage winding, the connection support means passes through a point distanced from the outer diameter surface by a length based on one third of a thickness of the low voltage winding, and in the high voltage winding, the connection support means passes through a point distanced from the inner diameter surface by a length based on one third of a thickness of the high voltage winding.

* * * * *